US007628677B1

(12) United States Patent
Branton et al.

(10) Patent No.: US 7,628,677 B1
(45) Date of Patent: Dec. 8, 2009

(54) AUTOMATED INSULATION MILLING MACHINE

(76) Inventors: H. T. Branton, 7405 Ashborne Dr., Harahan, LA (US) 70123; Steven J. Stair, 334 Deer Crossing, Stonewall, LA (US) 71078; Dean S. Shelton, 11 Pitre La., St. Rose, LA (US) 70087

( * ) Notice: Subject to any disclaimer, the term of this patent is extended or adjusted under 35 U.S.C. 154(b) by 41 days.

(21) Appl. No.: 11/803,600

(22) Filed: May 15, 2007

(51) Int. Cl.
*B24B 49/00* (2006.01)

(52) U.S. Cl. ..... 451/9; 451/10; 451/11; 451/69; 451/184; 451/190; 451/194; 451/336; 451/914; 125/19

(58) Field of Classification Search ..... 451/5, 451/8, 9, 10, 11, 69, 184, 190, 194, 300, 451/336, 339, 907, 914; 125/13.01, 19, 21
See application file for complete search history.

(56) References Cited

U.S. PATENT DOCUMENTS 3,918,210 A * 11/1975 Mori ..... 451/190
4,140,036 A * 2/1979 Davis ..... 83/861
4,256,078 A * 3/1981 Whitty ..... 125/3
4,295,263 A * 10/1981 Davis ..... 29/561
4,619,167 A * 10/1986 Davis ..... 83/607
6,234,882 B1 * 5/2001 Young ..... 451/260
6,672,192 B2 * 1/2004 Kaspersion ..... 83/607

* cited by examiner

*Primary Examiner*—Eileen P. Morgan
(74) *Attorney, Agent, or Firm*—Roy, Kiesel, et al.

(57) ABSTRACT

An automatic insulation block milling machine is disclosed. The machine combines a series of operations into a single, automatic, production-line machine. Blocks of rigid insulation material, such as cellular glass blocks, are fed into the automated machine. The blocks are first placed on an automatic programmed moving conveyor belt and are first cut on a pre-determined angle developed from the horizontal and vertical centerline of the block. This cut is made by an angled, vertical band saw mounted with its blade in the center of the moving conveyor, thus producing one angled side on each of the two cut blocks. The remaining three primary sides of the cut blocks are machined to create curved sectional blocks that are used to cover the outer surface of large bore pipe systems or other cylindrical items such as tanks.

17 Claims, 4 Drawing Sheets

Fig 2
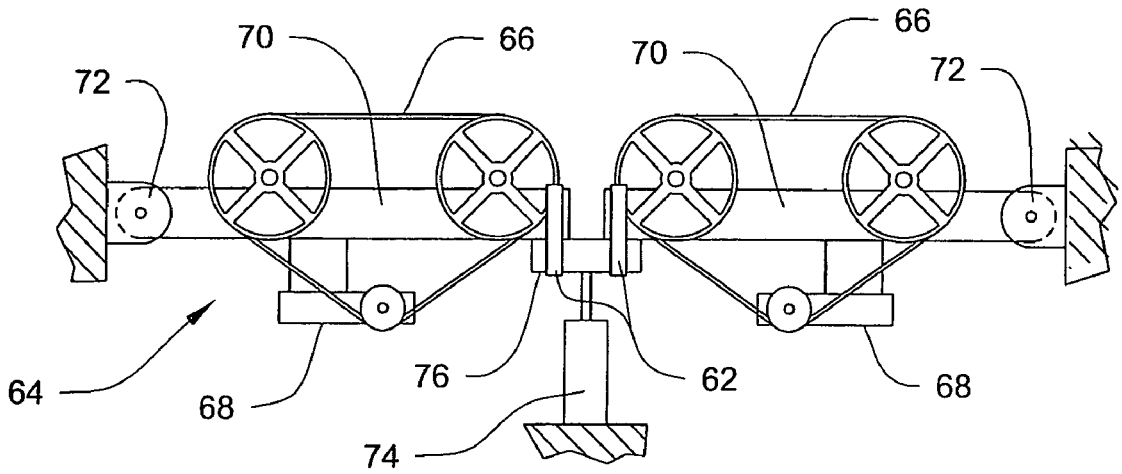
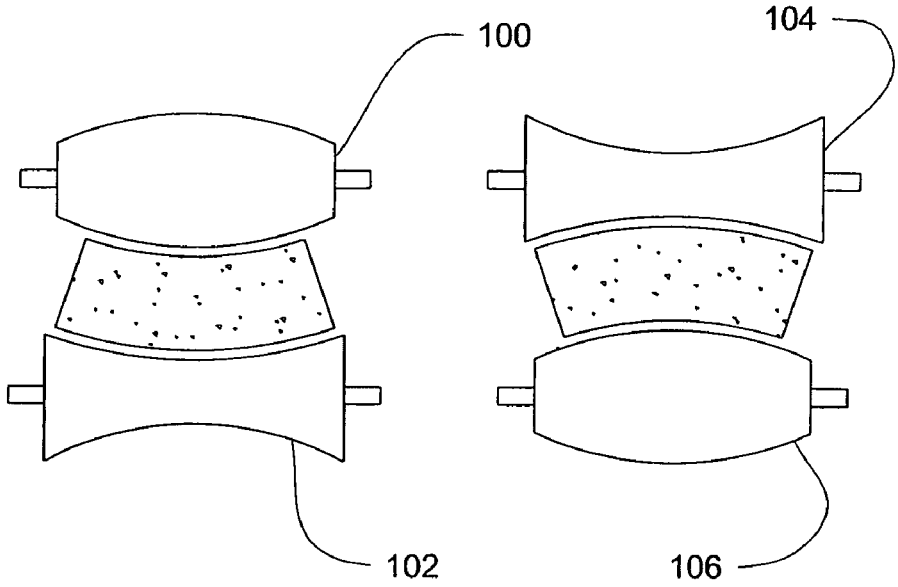
Fig 3

AUTOMATED INSULATION MILLING MACHINE

FIELD OF THE INVENTION

The present invention relates generally to the automated forming of radial, curved sectional, insulation blocks for large volume applications. The invention is an automatic insulation block milling machine.

BACKGROUND AND SUMMARY OF THE INVENTION

Insulating materials are widely used to insulate piping, valves, and related components in both hot and cold applications. Insulation is used both to retain the heat or cold of the substance within the system, and to protect persons from injury caused by direct contact with an extremely hot or cold surface. This type of insulation can be made and installed in several ways. Cloth or fabric insulation may be wrapped around the item to be insulated. A type of plaster or paste material that hardens as it dries may be formed about pipes. Blocks of insulating material may be cut or formed to fit over pipes and other items.

These types of pipe insulation are widely used and work well for relatively small diameter piping. For example, in most situations, a four inch or eight inch pipe can be insulated using any of the previously mentioned methods. The particular type of material used often depends upon the application. High temperature materials may require a different type of insulation than low temperature materials. Nevertheless, when the piping diameters are relatively small (e.g., one foot or less), traditional insulating methods tend to work well.

When blocks of insulating material are used with relatively small diameter piping, it is common to cut or form the insulation in two sectional pieces. Each piece would cover approximately one-half the surface area of the pipe. These two blocks of insulation may be secured to the pipe using a variety of methods, such as mastic, wrapping with cloth or fabric, or with metallic bands.

Some low temperature applications require a great deal of insulating material. For example, a liquefied natural gas (LNG) terminal may require 10,000 to 55,000 lineal feet, or more, of mostly large-diameter piping to be insulated. Because LNG is a very low temperature material (approximately minus 259° F.), and because of the long and large-diameter piping runs, it is important to achieve very good insulation on the piping runs. The cut or formed block method described above works well in such applications, in that it provides a good insulating seal, and the thickness of the blocks can be varied to provide as much, or as little, insulation as required by a particular job. There is, however, one important limitation of the cut or formed block process described above.

When insulation blocks are created to cover one-half of a pipe's circumference, the pipe cannot be very large. When pipe diameters reach or exceed one foot, this method no longer works well, because it requires very large blocks, and creates a great deal of waste because so much of the blocks must be cut away to fit the pipe. This problem is reduced if instead of using two cut blocks, four are used, with each block covering approximately ¼ of the circumference of the pipe. Yet even using four cut blocks will require large blocks and create a great deal of waste, as piping sizes get larger.

To deal with this problem, the number of cut or formed blocks can be increased. As more blocks are used, the curvature required for each block decreases, thus decreasing the amount of material that must be removed from the blocks. This reduces waste, which is a desirable result. This approach has been used in applications with pipe diameters larger than one foot, and works well even for very large bore piping, such as applications with pipe diameters of three feet or more. As the pipe diameter increases, the number of blocks used to cover the full circumference of the pipe increases.

There is, however, a substantial trade off in using this practice. For a given length of pipe, a large number of individually cut or formed insulation blocks is needed. If, for example, twelve blocks are used to cover the full circumference of a particular pipe, then twelve blocks must be cut or formed for each length of pipe. It becomes a very labor intensive process.

One type of material used to insulate low-temperature applications is cellular glass, a material made of foamed silica glass melted at high temperatures. One product of this type is manufactured by Pittsburgh Corning Corporation and sold under the trademark FOAMGLAS®. Cellular glass is a vapor impermeable, fireproof, material with very good insulating qualities. Cellular glass is created in blocks, typically 18 inches wide by 24 inches long and in varying thickness, ranging from about 2 to 6 inches. In some applications, such as large LNG terminals, the insulation specifications require a greater thickness than can be achieved with a single layer of cellular glass cut blocks. Two layers of cellular glass blocks, therefore, may be used in such applications.

To appreciate the labor intensive nature of insulation block preparation for large diameter piping applications, consider an LNG terminal with 15,000 feet of pipe that must be insulated. Assume further that twelve cut blocks will be used to cover the pipe circumference. If the blocks are two feet in length, the job will require 90,000 individually cut or formed insulation blocks, per layer. If two layers are required for the job, a somewhat common situation, nearly 200,000 individually cut or formed blocks would be needed. Some jobs have over 50,000 lineal feet of piping. Such a job might require 500,000 or more cut blocks.

A better means of creating the required insulation blocks was needed. In the traditional process, an operator manually fed uncut cellular glass blocks through a vertical band saw, an annular saw, or some other type of saw to make an angled or curved cut. The blocks were then manually fed through further cutting or grinding steps to finish the block. The blocks created through this process are curved sectional shaped, with the inner surfaces curved to match the curvature of the outer surface of the pipe, and their outer surfaces curved to provide uniform insulation thickness. That means each final block had to be cut in some respect on its four largest surfaces. That is, each side had to be cut at an angle (to create the curved sectional shape), and the inner and outer surfaces had to be cut in a curved (i.e., convex or concave) fashion. In addition to the labor intensive nature of this work, the process included so many individual operator-performed steps that the risk of irregularities was substantial. A minor error or variation by an operator might result in poor fit or blocks that had to be discarded.

The present invention provides an automated machine for creating the needed insulation blocks. It allows for automated operation, and has the potential to generate cut blocks faster than operators can remove them from the machine. The invention greatly reduces the time and labor required to produce cut cellular glass insulation blocks, while providing consistent and uniform results. The invention also greatly enhances operator safety.

In a preferred embodiment, the present invention includes a feed conveyor; an adjustable angle vertical bandsaw positioned adjacent to the feed conveyor, such that insulation blocks are fed to the bandsaw by the feed conveyor; a cut block conveyor; an upper carriage positioned above the cut block conveyor, said upper carriage comprising a pull foot operatively connected to a pull foot ram, a first outer push arm operatively connected to a first push arm ram, and a second outer push arm operatively connected to a second push arm ram; a transport ram operatively connected to the upper carriage; a lateral separation assembly comprising a lower carriage operatively connected to a lower ram, said lower carriage further comprising at least two lateral drive belts and a mechanical stop; first and second grinding lines; a first adjustable angle side grinder positioned to grind an uncut side of a block moving along the first grinding line; a second adjustable angle side grinder positioned to grind an uncut side of a block moving along the second grinding line; a convex upper grinder positioned to grind an upper surface of a block moving along the first grinding line; a concave lower grinder positioned to grind a lower surface of a block moving along the first grinding line; a concave upper grinder positioned to grind an upper surface of a block moving along the second grinding line; and, a convex lower grinder positioned to grind a lower surface of a block moving along the second grinding line.

In a preferred embodiment, the invention further includes the steps of determining the number of curved sectional shaped insulation blocks needed to cover a full circumference of an item to be insulated; calculating a block side angle based on the number of curved sectional shaped insulation blocks needed to cover a full circumference of an item to be insulated; setting an angled vertical bandsaw to produce a cut at the block side angle; setting a side milling tool to machine an uncut side of an insulation block at the block side angle; cutting with the angled vertical bandsaw one side of the number of curved sectional shaped insulation blocks needed to cover a full circumference of an item to be insulated; machining with the side milling tool the uncut sides of cut blocks; arranging the cut and machined blocks in a circular pattern, with the blocks arranged side-to-side; measuring an inner diameter of the circle of arranged blocks; comparing the measured inner diameter to a specified project diameter; if the measured inner diameter is not approximately equal to the specified project diameter, making adjustments to the angle of cut of the vertical bandsaw and the angle of machining of the side milling tool to produce cut and machined blocks that produce a circle with a measured inner diameter that is approximately equal to the specified project diameter; repeating this process as necessary until the measured inner diameter is approximately equal to the specified project diameter; and, cutting and machining the required number of insulation blocks for the project.

BRIEF DESCRIPTION OF THE DRAWINGS

FIG. 2 shows a lower carriage assembly of a preferred embodiment.

FIG. 3 shows a cross-sectional view of the upper and lower grinders used in a preferred embodiment of the present invention.

DETAILED DESCRIPTION OF THE INVENTION

Figure 1A:
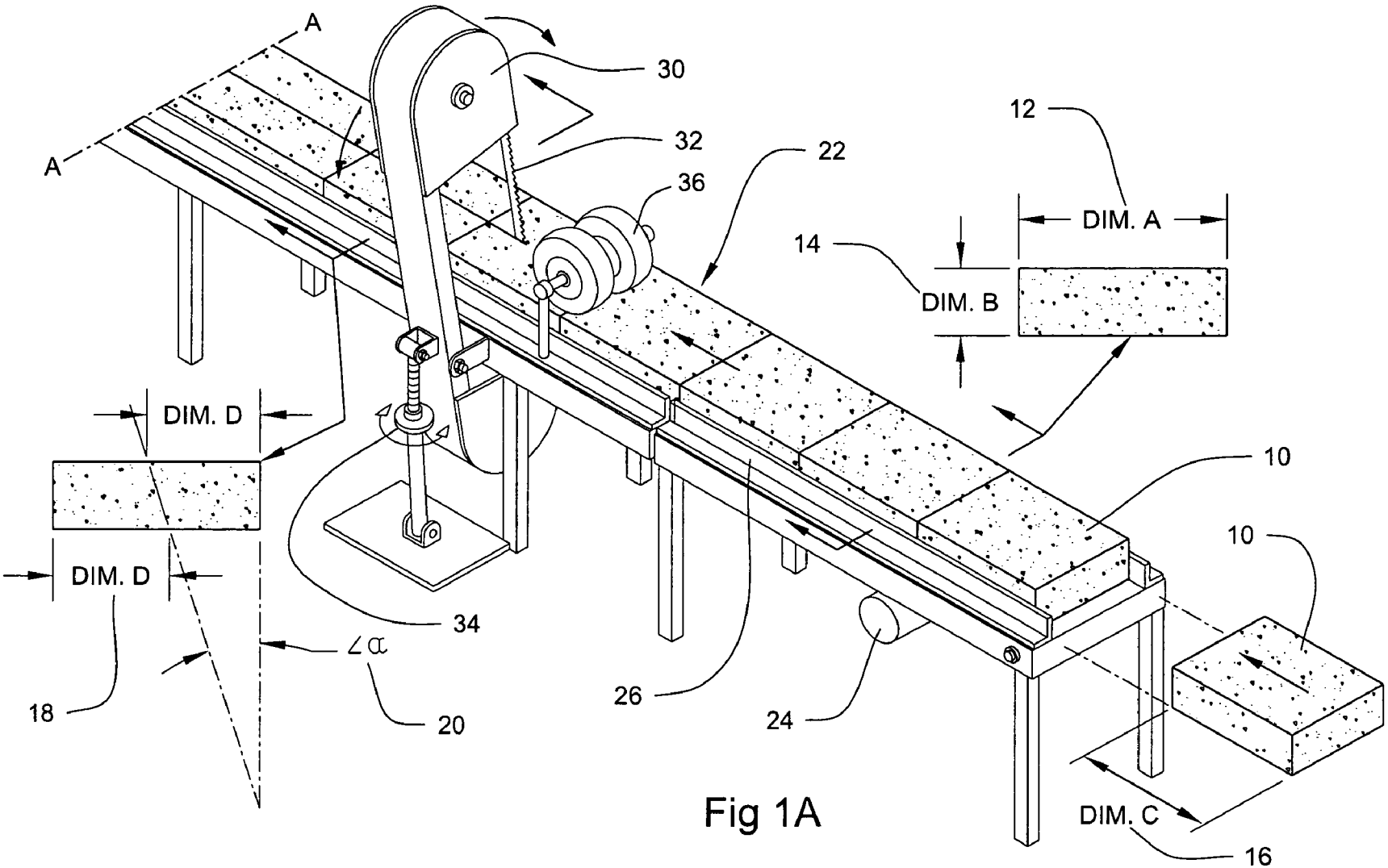
FIG. 1A is an isometric schematic of the cutting portion of a preferred embodiment of the present invention.
Figure 1B:
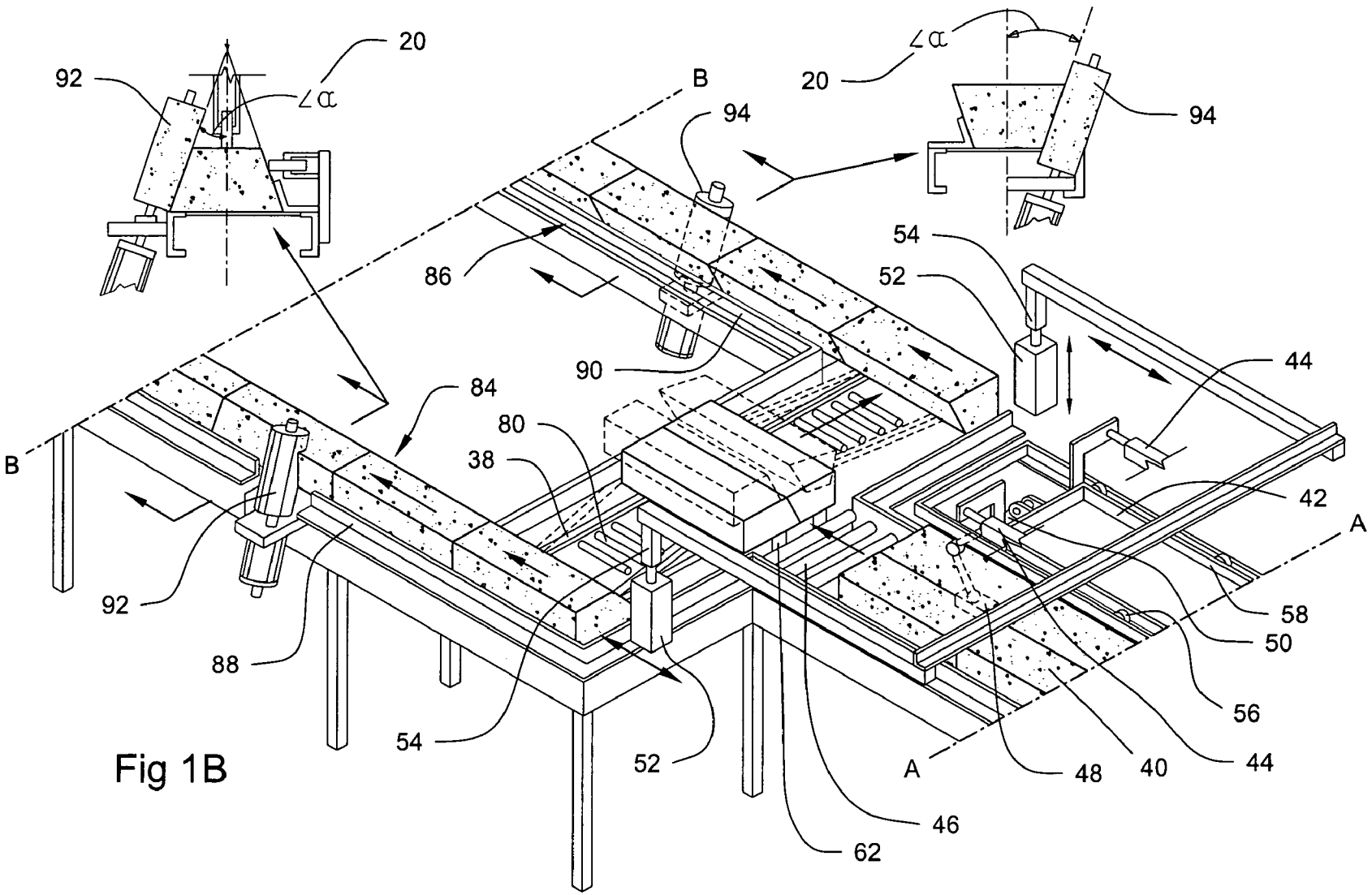
FIG. 1B is an isometric schematic of the transition portion of a preferred embodiment of the present invention.
Figure 1C:
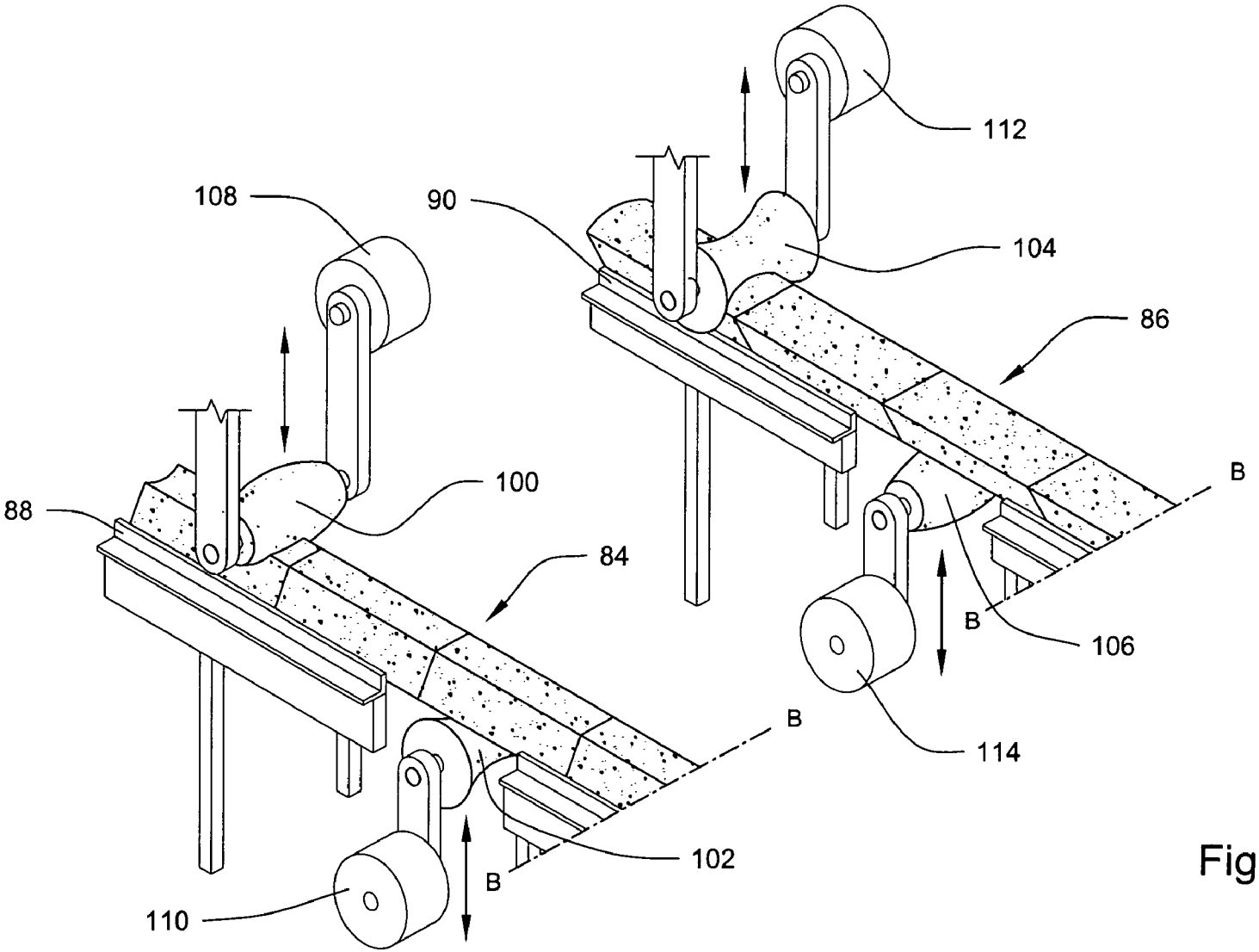
FIG. 1C is an isometric schematic of the grinding portion of a preferred embodiment of the present invention.

A preferred embodiment of the present invention is shown schematically in FIGS. 1A, 1B, and 1C. In FIG. 1A, the initial stages of the machining process are shown. Cellular glass blocks 10 are shown on a feed conveyor 22. FOAMGLAS® brand cellular glass blocks made by the Pittsburgh Corning Corporation may be used with the invention. The cellular glass blocks 10 have three dimensions, width 12, thickness 14, and length 16. Once cut into two pieces, the blocks have a longer, outer surface width 18, as shown in FIG. 1A. The blocks are cut at an angle 20.

An automated drive motor 24 powers the feed conveyor 22, which moves the blocks 10 toward a vertical bandsaw 30. Siderails 26 are used along the feed conveyor 22 to ensure the blocks 10 remain in proper alignment. Typical cellular glass blocks are 18" wide, so the siderails 26 may be fixed at that width. The siderails 26, however, are preferably adjustable to allow the machine to handle blocks of different widths.

The vertical bandsaw 30 uses a blade 32 to cut the blocks 10. In a preferred embodiment, the bandsaw blade 32 is a carbide-tipped blade. Such a blade provides a clean cut and lasts longer than standard blades. Cellular glass is an abrasive material that causes some wear of the saw blade. A carbide-tipped blade works well and has a reasonably long life in this application. A press-down roller 36 is positioned along the conveyor 22 to hold the blocks down on the moving conveyor belt and provide enough traction to force the blocks into the cutting operation. It is preferred that the roller 36 be adjustable to accommodate blocks of different thickness.

The vertical bandsaw 30 has an angular adjustment 34 that allows the saw to make cuts at any angle within a certain range. The angle 20 used for a particular run of insulation blocks is set based on the number of blocks that will be used to span the circumference of the cylindrical member being insulated. For example, if 12 blocks will be used for a particular job, the blocks will form wedges that span 30° each, such that twelve blocks span the full 360° circumference of the item requiring insulation. The angle 20 will be ½ of this value, as can be seen from FIG. 1A. The cut block 40 shown in cross-section in FIG. 1A reveals that the block with an angle 20 cut on one side will span only ½ of the angular distance it will cover when both sides have been cut at this angle. In the example given (i.e., with a total of twelve blocks being used), the angle 20 would be 15°.

Once the blocks are cut, they are moved into a transition area of the machine, where the cut blocks are separated and moved to two different grinding lines for further machining. These grinding lines each include three additional machining steps. The uncut side of the blocks is ground at the same angle 20 that was created by the vertical bandsaw 30. The top and bottom of the blocks (i.e., referring to their position as they lie on the conveyor) are ground to create curved surfaces. The shorter surface is ground to create a concave surface that becomes the inner surface of the block in use. The longer surface—that is, the surface with dimension 18—is ground to form a convex surface, and that surface will become the outer surface of the block in use.

The finished products are curved sectional shaped insulation blocks that are pieced together to form a continuous insulating layer around the pipe or other item to be insulated. In a preferred embodiment of the method of the present invention, a first run of blocks is created using the machine. Once enough blocks have been created to complete the cylindrical pattern, the blocks are positioned and checked for fit and size. To do this, one set of blocks—that is, the number of blocks needed to cover the circumference of the piping or other item to be insulated—is arranged in a circle. The blocks are positioned side-by-side. The top and bottom of the blocks may be machined at this point, though it is only necessary that the sides are cut and machined. The inner diameter of the circle formed by the arranged blocks is measured and compared to the specification for the project.

It is common for the measured diameter to differ a small amount from the specification diameter after the first run of blocks. The angle of the bandsaw and side angled grinders can be adjusted, as necessary to alter the diameter of the circle of blocks. Very small adjustments are usually all that is required. Once adjustments have been made, another run of blocks is produced, and the measurement taken again. The process can be repeated as necessary, but in practice one or two adjustments are usually sufficient. When a run of blocks is produced that has a measured diameter approximately equal to the specification diameter, the invention may be used to prepare thousands of blocks with almost no deviation from one block to the next.

We turn now to the transition portion of the machine of the present invention, as shown in isometric schematic view in FIG. 11B. Cut blocks 40 enter the transition area on input line rollers 46. A conveyor belt, roller wheels, or other means of allowing the blocks to move forward with minimal resistance may be used in place of the input rollers 46 shown in FIG. 1B. An upper carriage 42 is shown in FIG. 1B above the transition area of the machine. The upper carriage 42 performs two tasks. First, it moves cut blocks into a lateral separation area 38. Then, after being laterally separated, as explained in more detail below, the upper carriage 42 moves the separated cut blocks down the first and second grinding lines 84, 86. A lower carriage 64, which is not shown in FIG. 1B, performs operations necessary to separate the cut blocks and move them laterally to the grinding lines 84, 86.

The upper carriage 42 is moved by a transport ram 44. In a preferred embodiment, two transport rams 44 are used, with one located on each side of the upper carriage 42. It is also preferred that the rams used in the invention be pneumatic rams. Sufficient power is generated by pneumatic rams to perform the required operations. Hydraulic rams could be used, but are not preferred because the higher operating pressure of hydraulic rams presents more risk of damage to the machine or injury to an operator in the event of a problem with a ram or the hoses connected to the rams. In the most preferred embodiment, the pneumatic rams are operated with air at a pressure in the range of approximately 60 to 70 psi.

A pull foot 48 is connected to the upper carriage, and is used to move the cut blocks 40 into the lateral separation area 38. The pull foot 48 is operated by a pull foot ram 50. In a preferred embodiment, the pull foot ram 50 is pressurized to raise the pull foot 48 off a pair of cut blocks 40. When the ram 50 is vented, the weight of the pull foot 48 causes it to drop onto a pair of cut blocks. When the transport ram 44 is actuated, it moves the upper carriage 42. If the pull foot 48 is lowered onto a pair of cut blocks 40, when the upper carriage 42 is moved, the cut blocks will be pulled into the lateral separation area 38 by the pull foot 48. The upper carriage 42 may move along a track 58, using rollers 56. Any suitable means of allowing the upper carriage 42 to move in the direction of block travel is suitable.

Once the pair of cut blocks has been moved into the lateral separation area 38, the pull foot ram 50 is pressurized, thus lifting the pull foot 48 off the blocks. The transport ram 44 is then actuated to move the upper carriage 42 back to its previous position over another pair of cut blocks. The feed conveyor 22 will have fed another pair of cut blocks into the ready position by this time. A mechanical stop 62 is positioned at the end of the input line rollers to stop incoming blocks from being pushed into the lateral separation area 38. The feed conveyor 22 is stopped once a line of blocks has reached the mechanical stop 62.

The pair of cut blocks now positioned in the lateral separation area 38 is separated by a pair of lateral drive belts 66. These lateral drive belts 66 are raised and lowered by a lower carriage 64, which is not shown in FIG. 1B (see FIG. 2 for details of the lower carriage 64). The lateral drive belts 66 are raised after a pair of cut blocks have been moved into the lateral separation area 38. This action slightly lifts the cut blocks off the transfer area rollers 80, and allows the lateral drive belts 66 to separate the cut blocks, moving each one to a different side of the machine. The mechanical stop 62 is raised and lowered with the lateral drive belts 66, in a preferred embodiment, and thus prevents incoming pairs of cut blocks from being pushed onto the lateral drive belts 66.

When the lateral drive belts 66 are raised, the transfer area rollers 80 may not be used. Blocks cannot roll across the rollers 80 at this time because the lateral drive belts 66 would impede such movement. Moreover, if a pair of cut blocks moved into the lateral separation area 38 while the lateral drive belts 66 were raised, the edges of the blocks would contact the sides of the lateral drive belts 66, which could cause misalignment of the blocks, damage to the belts, or both. The mechanical stop 62 is used, in a preferred embodiment, to prevent this from occurring. Other means, such as an electronically activated brake, or an optically triggered brake would also work to fulfill this need.

The lateral drive belts 66 move the cut blocks into position to begin movement along the first and second grinding lines 84, 86. Once the blocks are in position on the grinding lines, the lateral drive belts 66 are lowered. When this has been done, the transfer area rollers 80 are again available. The mechanical stop 62 also is lowered at this time, thus allowing the upper carriage 42 and the pull foot 48 to engage another pair of cut blocks and move them into the lateral separation area 38. This process is repeated to continue moving cut blocks from the feed conveyor 22, through the transition area, and onto the grinding lines 84, 86.

The upper carriage 42 also operates the outer push feet 52. These feet 52 are positioned in alignment with the grinding lines 84, 86. A pair of push feet rams 54 is used to raise the push feet 52. In a preferred embodiment, the weight of the push feet 52 cause them to lower when the rams 54 are vented. In operation, the push feet rams 54 are vented once a pair of cut blocks has been separated and moved into position on the grinding lines 84, 86 by the lateral drive belts 66. This causes the push feet 52 to drop. The upper carriage 42 then moves in the direction of block travel due to actuation of the transport ram 44. The outer push feet 52 thus push the separated cut blocks along the grinding lines 84, 86. This movement occurs at the same time that the upper carriage 42 and the pull foot 48 are moving another pair of cut, but unseparated, blocks into the lateral separation area 38.

The transition area performs a two-part operation. During the first part, blocks are moved along their primary path of travel. Pairs of cut, but unseparated, blocks are moved into the lateral separation area 38 during this part of the operation, and separated blocks are pushed down the grinding lines at the same time. In the second part of the operation, the outer push feet 52 and the pull foot 48 are raised, and the upper carriage 42 returns to its starting position. While this is happening, the lateral drive belts 66 are raised, and the blocks recently moved into the lateral separation area 38 are separated and positioned at the start of the grinding lines.

The operation of the grinding lines 84, 86 is shown in FIGS. 1B and 1C. First and second grinding line side rails 88, 90 are used to maintain the blocks in proper alignment. These rails 88, 90 are adjustable to allow for different width blocks. First and second angled side grinders 92, 94 are also shown in FIG. 1B. As explained above, these grinders are set to produce the same angle 20 produced by the vertical bandsaw 30. In a preferred embodiment, the side grinders are covered with protective covers and a dust collection system is connected to those covers to remove the dust and debris created by the grinding operation.

The side grinders shown in FIG. 1B cut the same angle 20, but in opposite directions. The first angled side grinder 92 produces a curved sectional shaped block with a smaller top than bottom. In other words, the first angled side grinder 92 is angled inward moving from bottom to top. The second angled side grinder 94, however, is angled outward moving from bottom to top, and it produces a curved sectional shaped block having a wider top than bottom. By grinding the blocks in this manner, a pair of properly machined blocks is prepared without having to flip or turn the blocks during the machining process.

Because the blocks on each grinding line are inverses of each other (i.e. the curved sectional shaped block on the first grinding line has a top width equal to the bottom width of the curved sectional shaped block on the second grinding line, and vice versa), the top and bottom grinders also are inverses. An upper convex grinder 100 and a lower concave grinder 102 are used on the first grinding line 84, to create an upper concave surface and a lower convex surface on the cut block. The top of the block that emerges from the first grinding line 84 will be an inner surface in use, and the bottom of the block will be an outer surface in use. On the second grinding line 86, however, an upper concave grinder 104 and a lower convex grinder 106 are used to create an upper convex and lower concave surface on the cut block. The top of the block that emerges from the second grinding line 86 will be an outer surface in use, and the bottom of the block will be an inner surface in use. The upper and lower grinders are illustrated in FIGS. 1A and 3.

The lower carriage 64 is shown in FIG. 2. The lateral drive belts 66 are mounted on wheels 78 that are attached to the lower carriage rack 70. The rack 70 is mounted via a pivot 72 to the main frame of the machine. A lateral drive belt motor 68 powers the lateral drive belts 66. The lower carriage rack 70 is raised and lowered by a lower ram 74, that is attached to a lifting bar 76. A mechanical stop 62 is attached to the lifting bar 76, such that the stop 62 is raised and lowered with the lower carriage 64. In a preferred embodiment, the lower ram 74 is pressurized to raise the lower carriage 64, and the carriage 64 is lowered by venting the ram 74. A two-direction ram could be used to the same effect.

In a preferred embodiment, the sequence of operations described above is carried out through use of a number of micro-switches. In a preferred embodiment, a drive belt limit switch is used to deactivate the feed conveyor 22. This can be accomplished by stopping the drive motor 24. It is preferred, however, to allow the drive motor 24 to remain on, and to move the motor 24 so that it no longer engages its drive belt in order to stop the feed conveyor 22. The drive belt limit switch stops the feed conveyor 22 when a block or series of blocks it at or near the ready position, that is, when the blocks are near or reach the mechanical stop 62. The feed conveyor 22 is stopped to prevent it from continuing to try to push the blocks against the mechanical stop 62.

A block ready micro-switch may be used to indicate that a pair of cut blocks have been properly positioned for movement into the lateral separation area 38. Grinding line position switches may be used to detect the presence of a separated cut blocks at the beginning of the grinding lines 84, 86, and thus indicate that the outer push feet 52 may be lowered to move such blocks along the grinding lines. When a block ready switch and a grinding line position switch are triggered, the two-part sequence of operations described above may begin.

When the operation of the preferred embodiment described above is started for the first time, an operator must bypass the normal requirement that the a pair of cut blocks be in the ready position and that a pair of separated cut blocks be in position at the start of each grinding line. This is required because there are no separated blocks in place at the beginning of the grinding lines at this time. A pair of cut, but unseparated, blocks is in the ready position for movement into the lateral separation area 38. After one cycle has occurred, there will be a cut block in place at the start of each grinding line, and therefore, normal operations may proceed.

An end-of-travel switch may be used to indicate when the upper carriage has reached the end of its travel and needs to be retracted. Such a switch could be used to trigger the pressurization of the pull foot ram 50, the two push feet rams 54, and the lower ram 70. This operation would cause the pull foot 48 and push feet 52 to be raised so they no longer contact the blocks, and it would cause the lateral drive belts 66 to rise, thus contacting and separating a pair of cut blocks in the lateral separation area 38.

The preferred embodiment shown in the figures and disclosed in the preceding paragraphs may be modified in a number of respects. For example, the machine may include only one final grinding line. In this configuration, the lateral separation area 38 may not be needed, as the grinding line could be in line with the feed conveyor 22. In order to make such a configuration work, one of the cut blocks from each pair cut by the vertical bandsaw 30 would proceed directly to the grinding line, and the other cut block from the pair would be handled in a different manner. The second cut block of each pair (i.e., the one not fed directly into the grinding line) could be removed from the machine, either manually or by an automated process, such as a lateral conveyor. The removed blocks could then be held and fed through the grinding line at a later time.

The single grinding line configuration could also use a lateral drive belt system somewhat similar to that described in detail above. In this alternate configuration, the drive belts would move the second cut block of each pair (i.e., the one not fed directly into the grinding line) to the side where the block would be turned over and returned to the feed line. The block could be rotated by drive belts raised to a sufficient angle, and then returned to the feed line by lowering and reversing the same drive belts. Alternatively, the block could be manually turned over and returned to the feed line. By automating this process, one block could be fed directly into the feed line, and the second block turned over (using a belt system like that described above or by some other automated means) and returned to the feed line to follow the first block down the grinding line.

The single grinding line configuration is not preferred because it produces fewer blocks per operating time period. In addition, the single grinding line configuration requires either additional systems for automatically turning blocks or manual intervention by an operator. The latter is not preferred because it adds to labor costs and requires an operator to perform actions on the machine during operation, which could raise safety concerns. It is to be understood, however, that a single grinding line configuration is within the scope of the present invention.

The preferred embodiment shown in the figures and discussed above may also use other types of milling tools to produce the required machined surfaces on the blocks. Annular saws could be used to cut the upper and lower curved surfaces, thus replacing the concave and convex grinders shown and described above. Such saws are known in the art, and have been used to form insulation blocks. A multi-blade milling or shaping tool, configured with a curved cutting line, could also be used as a milling tool in place of the grinders shown and described above. Any type of milling tool capable of producing the curved upper and lower surfaces could be used to perform those functions of the present invention.

The second angled side of the finished blocks may be produced using a bandsaw similar to the vertical bandsaw 30 used to make the first cut in the blocks. Two additional saws could be used, with one positioned to cut the outer side of blocks on the two grinding lines. Alternatively, a multi-bladed cutting tool, or other type of straight-cut saw could be used to perform this function of the invention.

When the invention is properly understood, it can be seen that the grinding lines of the preferred embodiment are just one embodiment of the more general milling lines of the present invention. The grinders shown in the figures and described above are but one type of milling tool that may be used with the invention. The milling lines of this invention may use a variety of different milling tools.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

We claim:

1. An insulation block milling machine, comprising:

a) a feed conveyor;

b) an adjustable angle vertical band saw positioned adjacent to the feed conveyor, such that insulation blocks are fed to the band saw by the feed conveyor to be cut into a pair of cut blocks;

c) a cut block conveyor positioned adjacent to the adjustable angle vertical band saw, such that the pair of cut blocks may be moved away from the adjustable angle vertical band saw for further processing;

d) a lateral separation assembly positioned adjacent to the cut block conveyor and configured to laterally separate the pair of cut blocks such that a first cut block of the pair is positioned on a first grinding line and a second cut block of the pair is positioned on a second grinding line that is separated by a lateral distance from the first grinding line, wherein the lateral separation assembly further comprises at least two lateral drive belts configured to laterally separate the pair of cut blocks;

e) an upper carriage positioned above the cut block conveyor and the lateral separation assembly, said upper carriage operatively connected to a transport ram, wherein the transport ram is configured to move the upper carriage assembly and the upper carriage assembly is configured to move the pair of cut blocks from the cut block conveyor into the lateral separation assembly and, following lateral separation of the pair of cut blocks, to move the first cut block along the first grinding line and the second cut block along the second grinding line;

f) a first adjustable angle side grinder positioned to grind an uncut side of the first cut block moving along the first grinding line;

g) a second adjustable angle side grinder positioned to grind an uncut side of the second cut block moving along the second grinding line;

h) a convex upper grinder positioned to grind an upper surface of the first cut block moving along the first grinding line;

i) a concave lower grinder positioned to grind a lower surface of the first cut block moving along the first grinding line;

j) a concave upper grinder positioned to grind an upper surface of the second cut block moving along the second grinding line; and, k) a convex lower grinder positioned to grind a lower surface of the second cut block moving along the second grinding line.

2. The milling machine of claim 1, further comprising a dust collection system with dust collection intakes located near each of the grinders, such that a substantial portion of the dust generated by the grinding process is removed from the air around the insulation block milling machine.

3. An insulation block milling machine comprising:

a) a vertical band saw;

b) a powered feed conveyor positioned to feed insulation blocks through the vertical band saw producing a pair of cut blocks;

c) a milling line positioned to receive blocks cut by the vertical band saw;

d) a side milling tool positioned adjacent to the milling line and configured to mill one side of each cut block moving along the milling line;

e) a first curved milling tool positioned above the milling line and configured to machine a first curved surface on a top side of each cut block moving along the milling line; and, f) a second curved milling tool positioned below the milling line and configured to machine a second curved surface on a lower surface of each cut block moving along the milling line.

4. The milling machine of claim 3, further comprising a second milling line that is laterally separated from the first milling line such that a pair of side-by-side cut blocks may be separated so that each cut block may positioned on one of the two milling lines.

5. An insulation block milling machine, comprising:

a) a powered feed conveyor;

b) a vertical band saw positioned to receive insulation blocks fed to the vertical band saw by the powered feed conveyor and configured to cut each incoming insulation block into a pair of side-by-side cut insulation blocks;

c) a lateral separation assembly positioned to receive each pair of side-by-side cut insulation blocks from the vertical band saw and to laterally separate the pair of cut blocks and to position each cut block on either a first milling line or a second milling line, where the first and second milling lines are separated by a lateral distance, and wherein i) the first milling line further comprises a first angled side milling tool, an upper curved milling tool, and a lower curved milling tool; and, ii) the second milling lines further comprises a second angled side milling tool, a second upper curved milling tool, and a second lower curved milling tool.

6. The milling machine of claim 5 wherein the vertical band saw is an adjustable angle vertical band saw.

7. The milling machine of claim 5, further comprising an upper carriage configured to move cut blocks from the powered feed conveyor to the lateral transfer assembly.

8. The milling machine of claim 5, wherein the upper carriage comprises a) a frame;

b) a center pull foot ram connected to the frame;

c) a center pull foot operatively connected to the center pull foot ram such that the center pull foot ram may exert force on center pull foot, thus causing the center pull foot to grip or release a pair of side-by-side cut insulation blocks;

d) first and second outer push foot rams connected to the frame;

e) first and second outer push feet operatively connected to the first and second outer push foot rams, respectively, and configured to push laterally separated cut blocks down the first and second milling lines, respectively; and, f) a transport ram connected to the frame and configured to move the pair of side-by-side cut insulation blocks into the lateral separation assembly.

9. The milling machine of claim 8, wherein the rams are pneumatic rams.

10. The milling machine of claim 5, wherein the lateral transfer assembly further comprises a lower carriage operatively connected to a lower carriage ram and having at least two lateral separation drive belts.

11. The milling machine of claim 10, wherein the lower carriage further comprises a mechanical stop configured to block movement of cut blocks into a lateral separation area when cut blocks are being laterally separated by the lateral transfer assembly.

12. The milling machine of claim 5, wherein the powered feed conveyor is stopped when cut blocks are being laterally separated by the lateral transfer assembly.

13. The milling machine of claim 5, further comprising a sensor configured to detect when a pair of cut blocks are in a proper position for movement into a lateral separation area.

14. The milling machine of claim 5, wherein the side, upper, and lower milling tools are grinders.

15. The milling machine of claim 5, wherein the upper curved milling tools are adjustable to accommodate insulation blocks of varying thickness.

16. The milling machine of claim 5, wherein the vertical band saw and the angled side milling tools are set to approximately the same angle.

17. The milling machine of claim 5, wherein the first upper milling tool has a convex profile, the first lower milling tool has a concave profile, the second upper milling tool has a concave profile, and the second lower milling tool has a convex profile.

* * * * *